US005703608A

United States Patent [19]

Kuga

[11] Patent Number: 5,703,608

[45] Date of Patent: Dec. 30, 1997

[54] SIGNAL PROCESSING CIRCUIT

[75] Inventor: Kaeko Kuga, Kyoto, Japan

[73] Assignee: Rohm Co., Ltd., Tokyo, Japan

[21] Appl. No.: 538,375

[22] Filed: Oct. 3, 1995

[30] Foreign Application Priority Data

Oct. 4, 1994 [JP] Japan ..... 6-240103

[51] Int. Cl.[6] ..... G09G 3/36

[52] U.S. Cl. ..... 345/99; 327/93; 327/94

[58] Field of Search ..... 345/98, 92, 99–100; 327/91, 93, 94

[56] References Cited

U.S. PATENT DOCUMENTS 4,390,844 6/1983 Ting ..... 327/94
4,823,027 4/1989 Takahashi ..... 327/94
4,939,472 7/1990 Uchida et al. ..... 327/91
5,017,924 5/1991 Guiberteau et al. ..... 327/94
5,341,050 8/1994 Mellissinos et al. ..... 327/91

*Primary Examiner*—Richard Hjerpe
*Assistant Examiner*—Vui T. Tran
*Attorney, Agent, or Firm*—Nikaido Marmelstein Murray & Oram LLP

[57] ABSTRACT

A signal processor alternately outputs two input signals to a common output terminal every predetermined period to form a single serial signal. A capacitor for holding the input signal is provided on each input signal transmitting path. A buffer is provided at each of the preceding and succeeding stages of each capacitor. The turning on and off of these buffers is controlled by a single switch. The switch is controlled so that when one capacitor is supplied with the input signal, the other capacitor outputs a signal.

7 Claims, 10 Drawing Sheets

SIGNAL PROCESSING CIRCUIT

BACKGROUND OF THE INVENTION

1. Field of the Invention

The present invention relates to a signal processor suitable for sampling and holding a video signal to supply it to a video display device, in particular, a liquid crystal display device.

2. Description of the Prior Art

In recent years, liquid crystal display devices have been frequently used as video display devices for apparatuses such as portable personal computers, wordprocessors, liquid crystal television sets and liquid crystal video cameras because of its light weight. Of these liquid crystal devices, a liquid crystal display (hereinafter referred to as LCD) using a thin film transistor (hereinafter referred to as TFT) as the active element is considered to be promising and research and development have been performed thereon.

First, the structure of a TFT panel will be described. The TFT-LCD has a structure as shown in FIG. 6 such that two glass plates 100 are fixed to face each other with a space of several micro meters therebetween and a liquid crystal 101 is filled in the space. On a lower glass plate 100*b*, signal lines 102 and scanning lines 103 are arranged in a matrix. To their intersections, TFTs 104 and transparent pixel electrodes 105 are connected. By sandwitching the TFT-LCD between two polarizing plates 106*a* and 106*b* and irradiating white light thereon, a transmission-type LCD is obtained. A color filter 107 consists of the three primary colors of red (R), green (G) and blue (B) and arranged in accordance with the pixel electrodes 105.

This type of arrangement of the color filter is called a triangle arrangement. A mosaic arrangement is also known. The triangle arrangement is suitable for video display, whereas the mosaic arrangement is suitable for display of data such as characters.

Subsequently, the driving method will be described. FIG. 7 is a timing chart of the waveforms of signals to drive the TFT-LCD. In the figure, $V_G$ and $V_{ID}$ are signals of the scanning line 103 and the signal line 102 which are inputted to the gate and the source of the TFT, respectively. As is well known, the NTSC video signal consists of interlaced two fields, and a first field and a second field are combined to form one frame, thereby building up one image. Typically, in providing a video display in the TFT-LCD, a 30 Hz video signal which alternates every field period (1/60 sec) is applied to the liquid crystal according to the noninterlacing (overwriting odd-line and even-line video signals in the same line) method. In order to obtain a full-line display, it is necessary to scan at a double speed by using a memory such as a frame memory (a method usable for IDTV) or to provide the same signal for every two scanning lines and change the combination every field.

When the TFT 104 is activated in a selection period $T_1$ (one horizontal scanning period), a potential $V_P$ of the pixel electrode 105 equals a potential $V_{ID}$ of the signal line 102. In a selection period $T_2$, the TFT 104 is deactivated and the signal written to the liquid crystal capacity (and the holding capacity) is held. However, the moment the TFT 104 is deactivated, the potential $V_P$ is shifted by a potential $\Delta V$. This is because of a capacity coupling between a gate-drain parasitic capacity $C_{GD}$ and gate-drain liquid crystal and holding capacities $C_{LC}$ and $C_{ST}$ of the TFT. The value of the capacity coupling is expressed as follows:

$$\Delta V = \Delta V_G \frac{C_{GD}}{C_{GD} + C_{LC} + C_{ST}} \quad (1)$$

where $\Delta V_G$ is the amount of variation in potential of the scanning line 103.

The shift voltage always decreases the potential $V_P$ of the pixel electrode 105 irrespective of the polarity of the video signal. Therefore, a potential $V_{COM}$ of a common potential 108 of the color filter 107 is set to be lower by the shift potential than a central potential $V_C$ of the signal line 102. Thereby, the range of the voltage applied to the liquid crystal is as shown as a hatched portion and takes a waveform substantially symmetrical in the positive and negative direction. In actuality, however, because of the dielectric anisotropy of the liquid crystal 101, the liquid crystal capacity $C_{LC}$ varies according to the amplitude of the video signal to vary the shift voltage $\Delta V$. Consequently, even though the potential $V_{COM}$ of the common electrode 108 is optimized, the voltage applied to the liquid crystal 101 cannot take a completely symmetrical waveform. The asymmetrical component thus generated becomes an optical component of 30 Hz and recognized as an image flicker. To prevent this, the shift voltage $\Delta V$ may be reduced. Specifically, the size of the TFT is necessarily minimized to produce a sufficient holding capacity. As another flicker prevention, the polarity of the video signal is reversed every signal line 102 or every scanning line 103 to average the flickers in the entire display screen so that they cannot be seen well.

Moreover, the shift voltage $\Delta V$ corresponds to a direct current potential between the signal line 102 and the pixel electrode 105. If such a direct current electric field is present in the liquid crystal layer, problems such as residual images (phenomenon that when an image quickly moved, the display cannot follow it) and sticking (phenomenon that when a stationary pattern is displayed for a long time, the pattern remains in the display screen after the displayed image is changed) are caused and the reliability of the liquid crystal is reduced. Therefore, in order to obtain a high image quality and a high reliability, it is necessary to reduce the shift voltage $\Delta V$.

FIG. 8 shows a circuit provided for each pixel of such a TFT-LCD. The drain of a metal oxide semiconductor field effect transistor (hereinafter, referred to as MOSFET) constituting the TFT 104 is connected to the signal line 102. The gate of the MOSFET is connected to the scanning line 103. The capacity of the liquid crystal 101 is coupled to the source of the MOSFET so that the potential of the signal line 102 gathers between the liquid crystal 101 and the common electrode 108 every time the TFT is activated by the scanning line 103.

FIG. 9 is a block diagram showing a television receiver employing the above-described pixel and LCD. In the figure, a broadcasting wave received by an antenna 200 is converted into a video signal $S_{VI}$ and an audio signal $S_S$ by a tuner, an IF amplifier and a video detecting circuit 201. The audio signal $S_S$ is outputted from a speaker 206 through an audio amplifier 205.

On the other hand, the video signal $S_{VI}$ has its tonal characteristics corrected by a $\gamma$ compensating circuit 202 and is transmitted by way of a video signal amplifier 203 to a sample and hold signal electrode driving circuit 207 and to a synchronizing circuit 204. At the synchronizing circuit 204, a horizontal synchronizing signal $S_H$ and a vertical synchronizing signal $S_V$ are extracted. From these signals, a frame start signal $F_S$ and a pixel clock signal $C_P$ are produced.

The horizontal synchronizing signal $S_H$ and the frame start signal $F_S$ are transmitted to a scanning electrode driving circuit 209 and drive the gate terminal of the TFT through the scanning 103 at each pixel. On the other hand, the video signal $S_{VI}$ is sampled and held by the sample and hold signal electrode driving circuit 207 in synchronism with the pixel clock $C_P$ and the vertical synchronizing signal $S_V$, and coupled to the drain terminal of the TFT through the signal line 102.

Thus, a signal processor which performs sampling and holding is indispensable to a TFT-LCD which displays the video signal $S_{VI}$. A conventional signal processor used in the sample and hold signal electrode driving circuit 207 is shown in the block diagram of FIG. 1. In the figure, reference numerals 1 and 2 represent input terminals, reference numeral 3 represents an output terminal, reference numerals 11 to 14 represent buffers, reference numerals 15 and 16 represent capacitors, and reference numerals 17 to 20 represent switches.

To the input terminals 1 and 2, for example, the video signals $S_{VI}$ for the first and second fields are input, respectively, so that the fields are non-interlaced. A signal A from the input terminal 1 goes through the buffer 11, the switch 17, the capacitor 15, the switch 18 and the buffer 13 to reach the output terminal 3. This path will be referred to as a first path α. A signal B from the second input terminal 2 goes through the buffer 12, the switch 19, the capacitor 16, the switch 20 and the buffer 14 to reach the output terminal 3. This path will be referred to as a second path β.

The capacitor 15 performs holding on the first path α. The capacity 16 performs holding on the second path β. The elements controlling the sampling to the capacitors 15 and 16 are the switches 17 to 20, which are controlled by pixel clocks $C_{P1}$ to $C_{P4}$ shown in FIG. 2, respectively. The switches 17 to 20 are turned on when the clocks $C_{P1}$ to $C_{P4}$ are low and turned off when they are high.

The switches 17 and 19 are turned on and off alternately, whereby waveforms as shown at G and H of FIG. 2 appear at terminals not connected to ground of the capacitors 15 and 16, respectively. The signals G and H are such that the two signals A and B are synthesized at the output terminal 3 through the buffers 13 and 14 by an alternate turning on/off of the switches 18 and 20 to obtain a signal as shown at I of FIG. 2.

According to the above-described conventional structure, however, at least two completely separate buffer-switch pairs constituting the signal processor are necessary and the output offset characteristic which is particular to each buffer is not uniform, so that flickers are apt to be caused. Moreover, since the switches are controlled independently of one another, the timing of the on/off control deviates due to the non-uniformity of the circuit pattern on the mask, so that video noises are caused. Further, since at least two switches are necessary, the scale of the circuit increases and the cost increases.

SUMMARY OF THE INVENTION

An object of the present invention is to provide a signal processor which realizes a high image quality and a high reliability with a simple structure.

A signal processor of the present invention is provided with the following: a first input terminal supplied with a first signal; a second input terminal supplied with a second signal; first and second input buffers connected to the first and second input terminals, respectively; a first capacitor connected to an output side of the first input buffer and to a reference potential point for holding the first signal; a second capacitor connected to an output side of the second input buffer and to the reference potential point for holding the second signal; a first output buffer connected to the first capacitor; a second output buffer connected to the second capacitor; an output terminal supplied with outputs of the first and second output buffers; a power source for activating the first and second input buffers and the first and second output buffers; and switch means which alternately repeats a period during which the first input buffer and the second output buffer are connected to the power source and a period during which the second input buffer and the first output buffer are connected to the power source.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
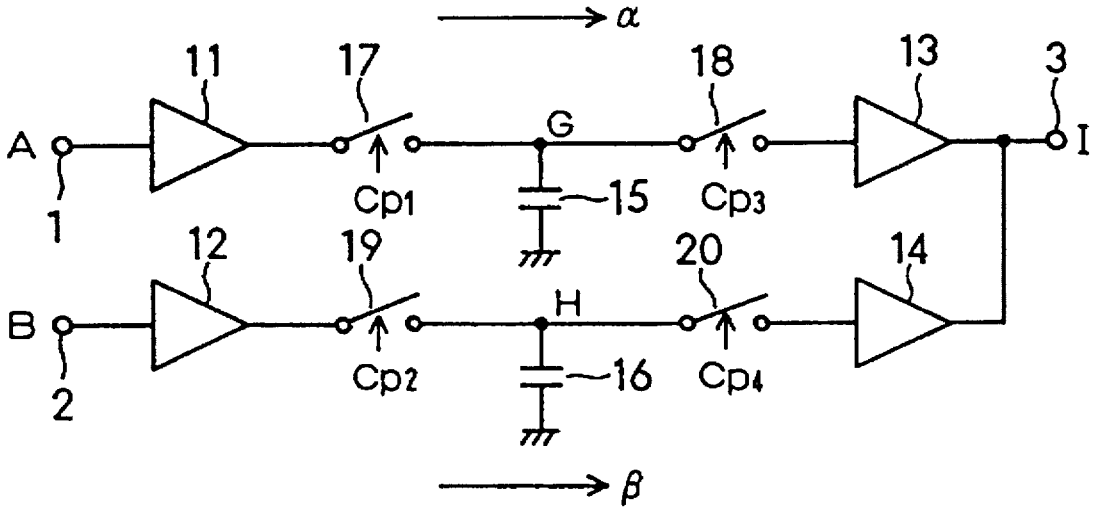
FIG. 1 PRIOR ART
FIG. 1 is a block diagram of a conventional signal processor.
Figure 2:
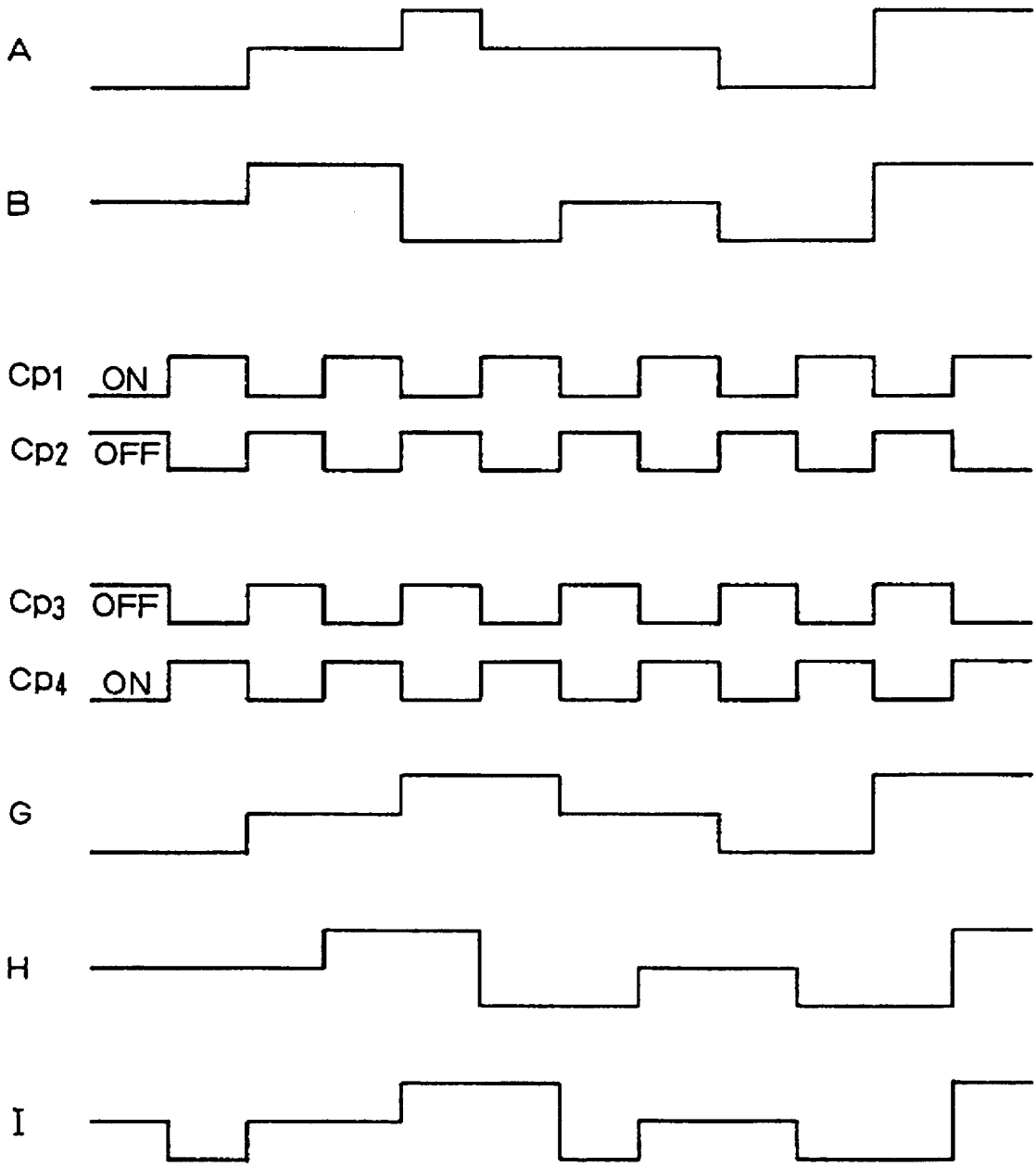
FIG. 2 PRIOR ART
FIG. 2 is a timing chart showing an operation of a principal portion of the conventional signal processor.
Figure 3:
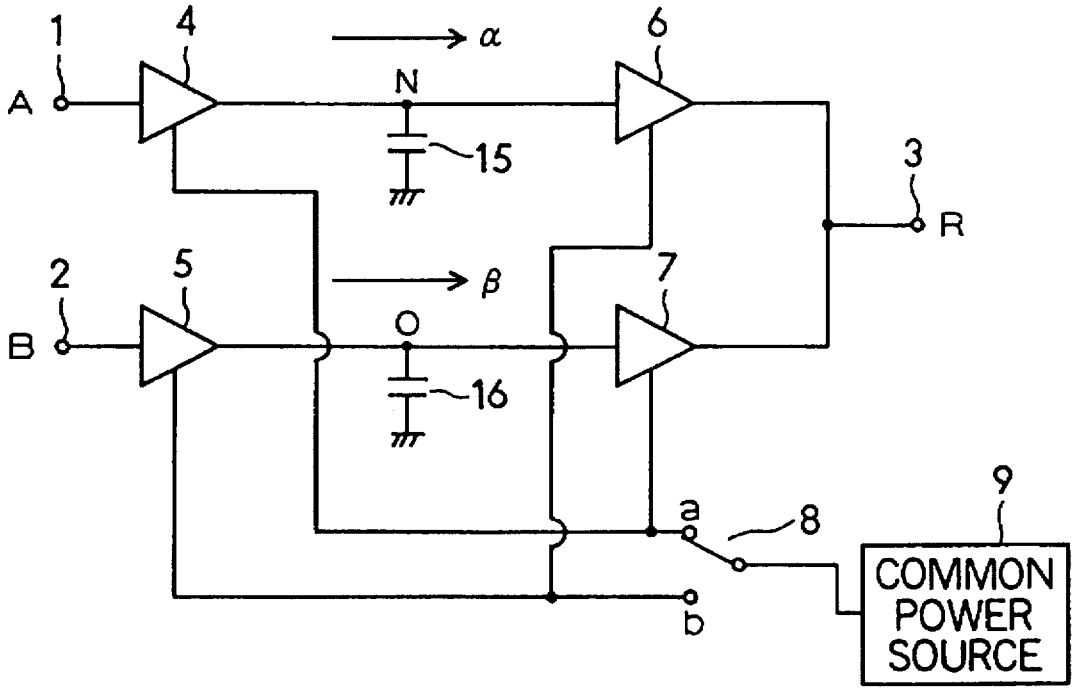
FIG. 3 is a block diagram of a signal processor embodying the present invention.

Hereinafter, an embodiment of the present invention will be described with reference to the drawings. FIG. 3 is a block diagram of a signal processor embodying the present invention. This signal processor is for use in the liquid crystal display described with reference to FIGS. 6 to 10. In FIG. 3, input terminals 1 and 2, an output terminal 3 and capacitors 15 and 16 will not be described in detail since they are the same as those of the prior art. Reference numerals 4 to 7 represent buffers whose power terminals can be externally controlled as shown in the figure. Reference numeral 8 represents a switch. Reference numeral 9 represents a common power source.

Like in the prior art, for example, video signals $S_{VI}$ of the first and second fields are input to the input terminals 1 and 2, respectively, so that the fields are non-interlaced. A signal A from the input terminal 1 goes through the buffers 4 and 6 to reach the output terminal 3. This path will be referred to as a first path α. A signal B from the input terminal 2 goes through the buffers 5 and 7 to reach the output terminal 3. This path will be referred to as a second path β.

Figure 4:
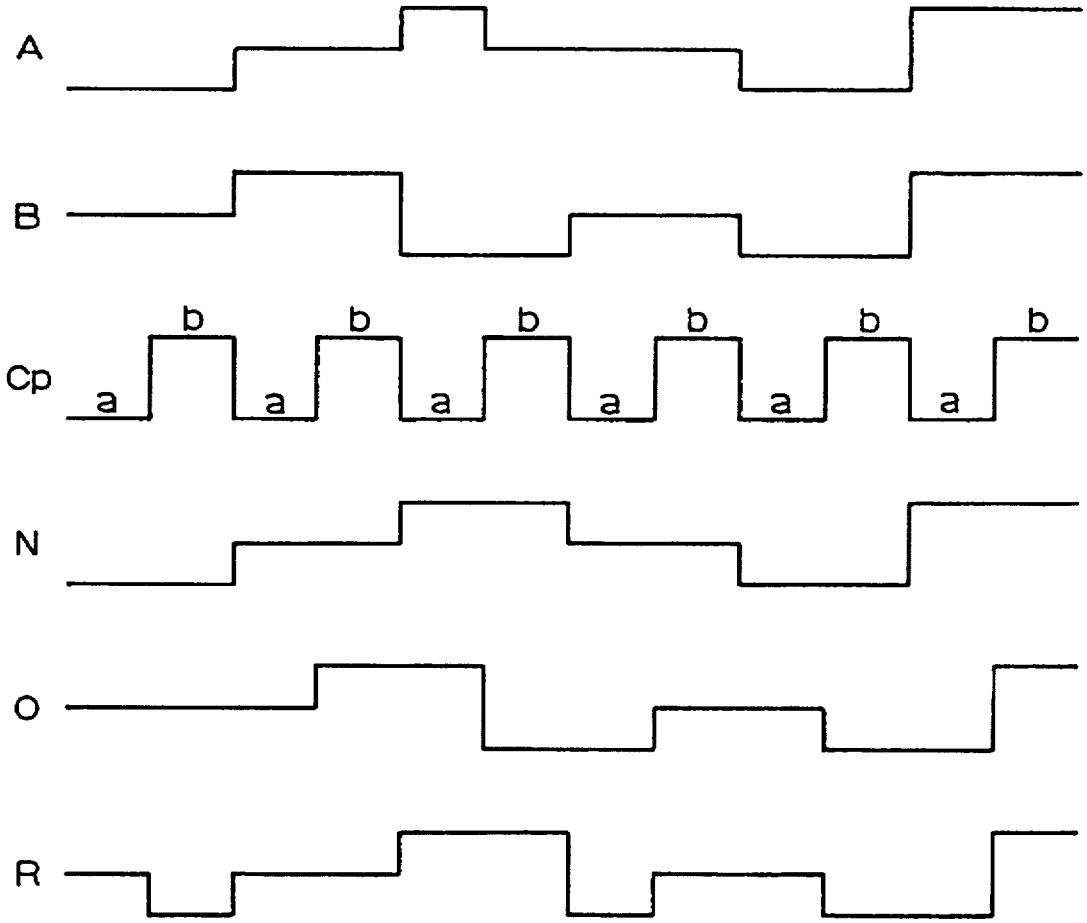
FIG. 4 is a timing chart showing an operation of a principal portion of the embodiment.

An operation of the signal processor of the present invention thus structured will be described with reference to a timing chart of FIG. 4 showing operations of main elements of this embodiment.

The switch 8 is connected to a contact a when the pixel clock $C_P$ is low and to a contact b when it is high. Here, the buffers 4 to 7 have circuit arrangements such that the impedance is maintained high when power supply is cut off. Thereby, when the pixel clock $C_P$ is low, the buffers 4 and 7 are supplied with power from the common electrode 9 to be activated and the buffers 5 and 6 are provided with no power to be deactivated. On the contrary, when the pixel clock $C_P$ is high, the buffers 4 5 and 7 are deactivated and the buffers 5 and 6 are activated.

The capacitor 15 performs holding on the first path α. The capacitor 16 performs holding on the second path β. The element controlling the sampling to the capacitors 15 and 16 is the switch 8, which is controlled by the pixel clock $C_P$ shown in FIG. 4.

By such a with-time variation in operation conditions of the buffers 4 to 7, the signals A and B corresponding to the video signals $S_{VI}$ of the first and second fields applied to the input terminals 1 and 2 are respectively held in the capacitors 15 and 16 in time series. The signals A and B take waveforms as shown at N and O of FIG. 4 and are transmitted by way of the buffers 6 and 7 to the output terminal 3 to be synthesized, so that a signal as shown at R of FIG. 4 is output. This output signal R is output to a liquid crystal display device 208 (see FIG. 9).

Figure 5:
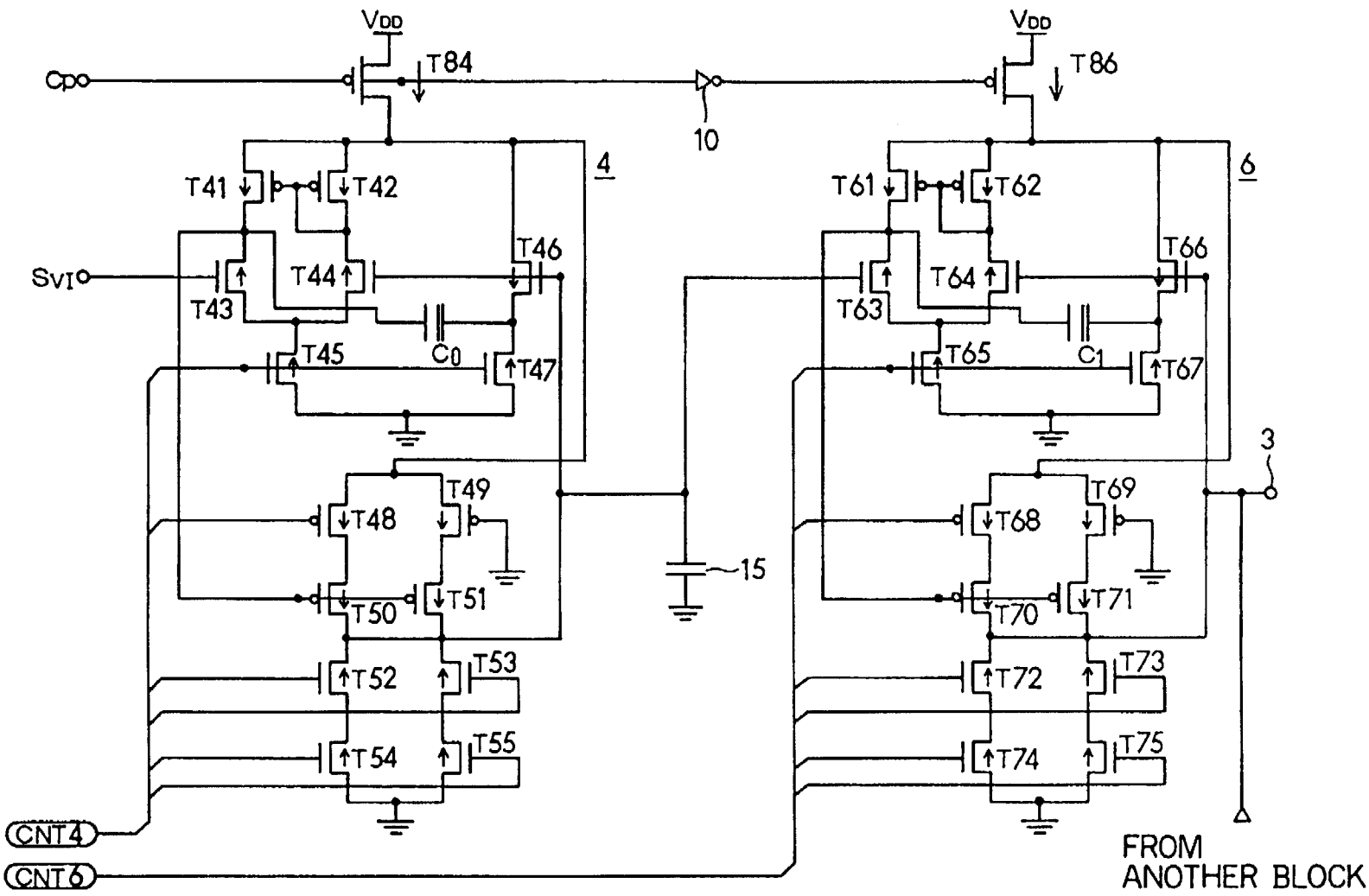
FIG. 5 is a circuit diagram of buffers of the embodiment.
Figure 6:
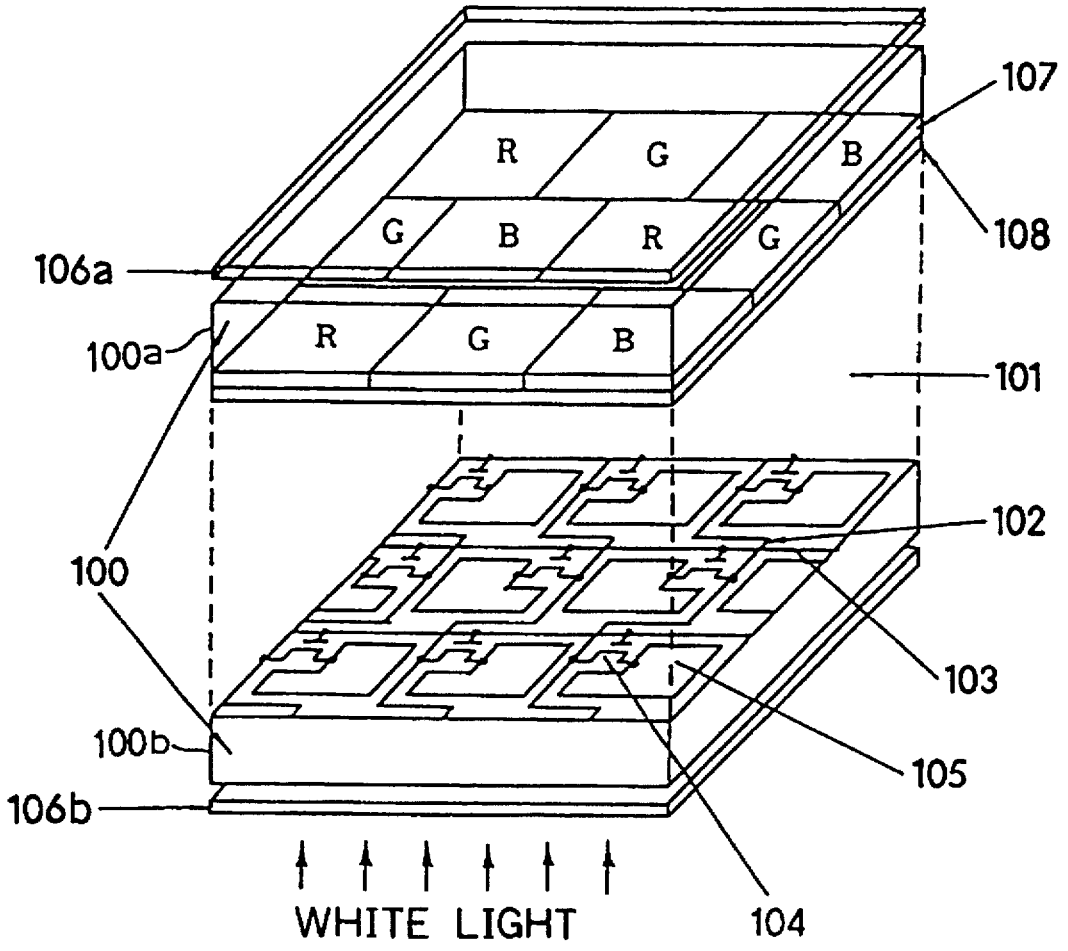
FIG. 6 shows the structure of a TFT-LCD driven by the signal processor of the present invention.
Figure 7:
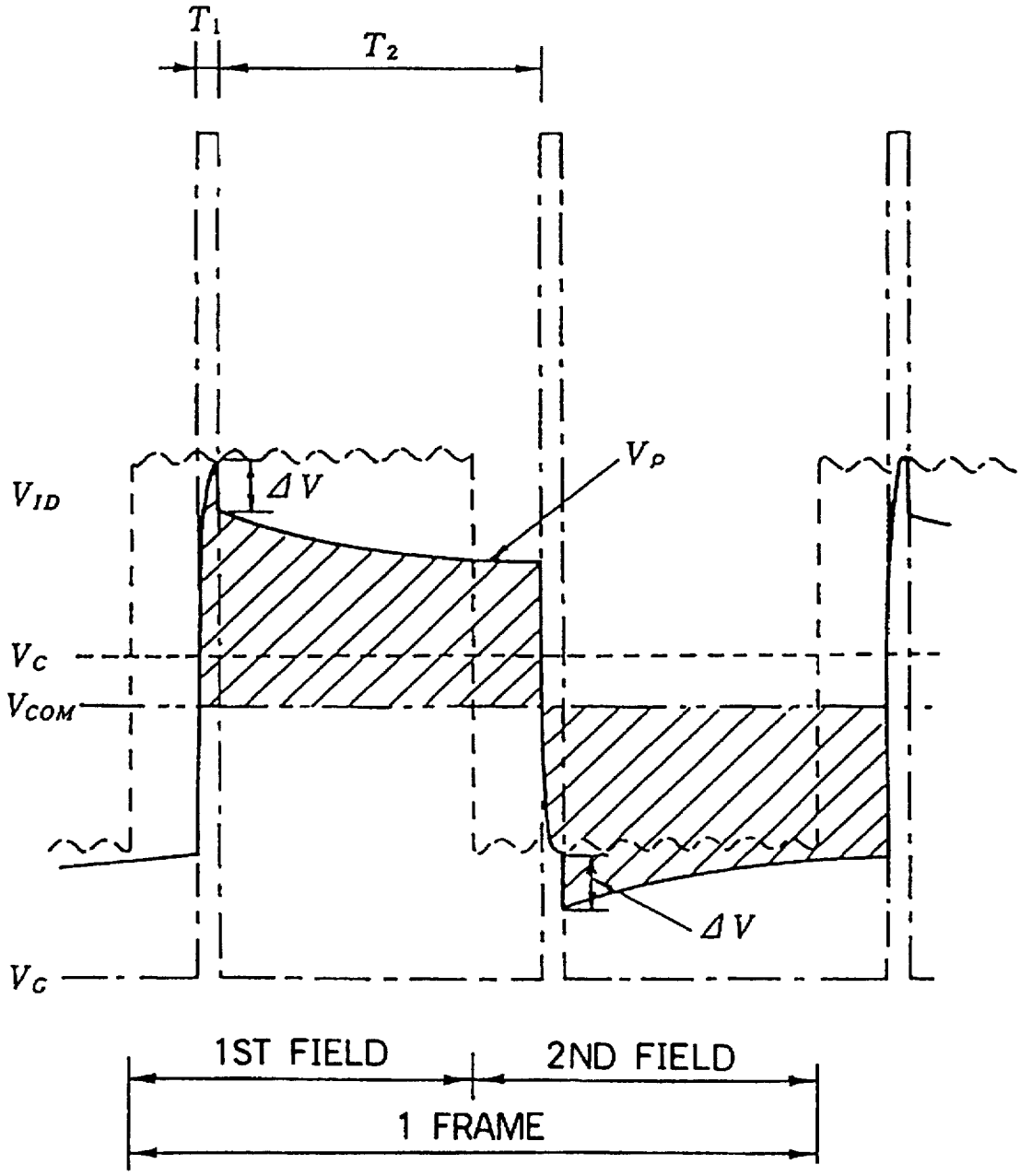
FIG. 7 is a timing chart of the waveforms of signals to drive the TFT-LCD.
Figure 8:
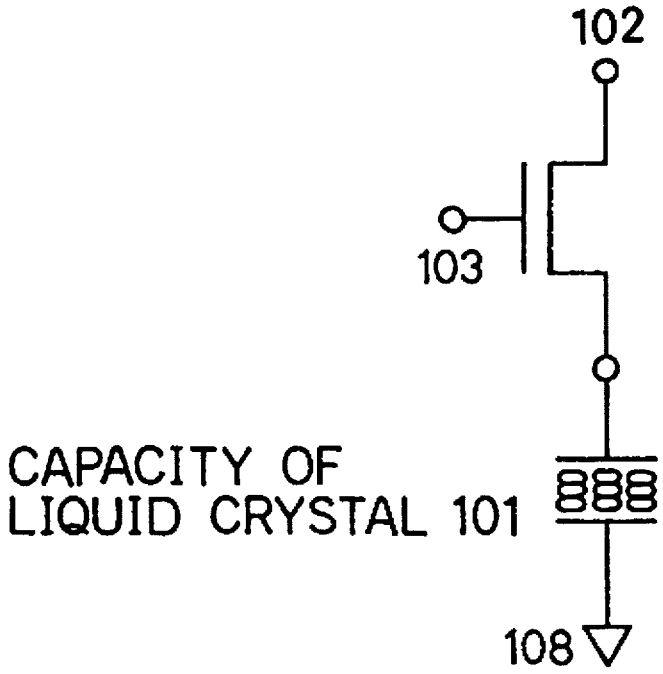
FIG. 8 is a diagram of a circuit provided for each pixel of the TFT-LCD.
Figure 9:
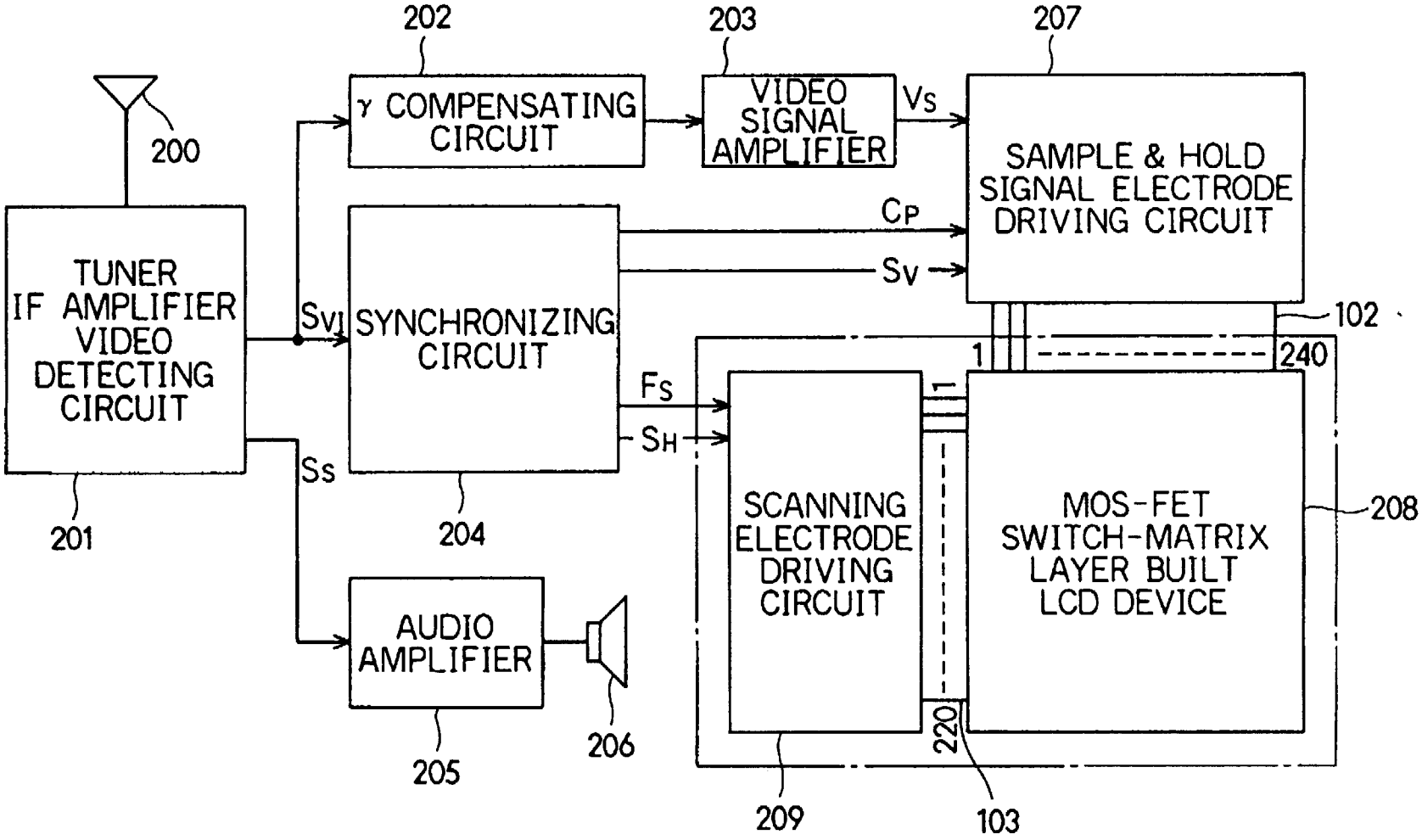
FIG. 9 is a schematic block diagram of a television receiver using the TFT-LCD.
Figure 10:
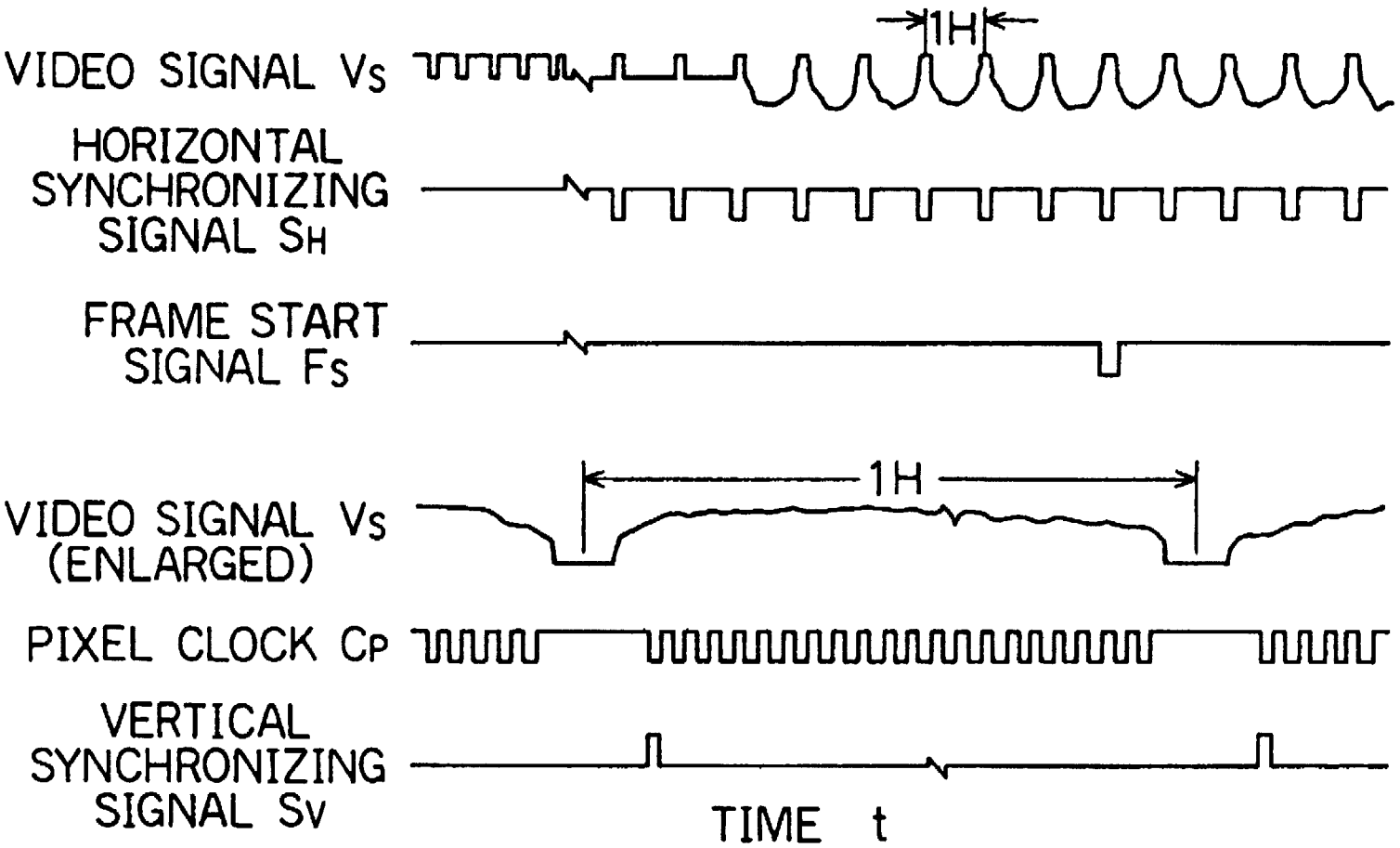
FIG. 10 is a signal waveform chart of a principal portion of FIG. 9.

For example, the buffers 4 and 6 and a part of the switch 8 on the first path α are easily realized in a circuit arrangement as shown in FIG. 5. In the figure, "↓" represents a P-channel MOSFET and "□" represents an N-channel MOSFET. Capacitors $C_0$ and $C_1$ are capacities for oscillation prevention and hardly affects the operation and characteristics.

In the figure, the switch 8 of this embodiment includes an inverter circuit 10 and P-channel MOSFETs T84 and T86. The output format of the buffer is a source follower including MOSFETs T50 to T55 and T70 to T75.

In this circuit, the MOSFETs T52 to T55 are controlled by a control input bus CNT4 and the MOSFETs T72 to T75 are controlled by a control input bus CNT6. The control input buses CNT4 and CNT6 synchronize with the pixel clock $C_P$ and are turned on and off in conjunction with the MOSFETs T84 and T86, respectively.

Specifically, when the pixel clock $C_P$ is high, the MOSFET T84 is activated and the MOSFET T86 is deactivated. At this time, the MOSFETs T52 to T55 are activated and the MOSFETs T72 to T75 are deactivated. When the pixel clock $C_P$ is low, the operation of each of the elements is opposite. Thereby, a high impedance deactivated state of the buffers as shown in FIG. 3 can be achieved.

While the case of two input signals is described in the above embodiment, the number of input signals may be three. Moreover, while the buffers 4 to 7 are analog complementary MOSFETs in the embodiment, they may be bipolar MOSFETs.

As described above, in the signal processor of the present invention, since the power source of the four buffers is turned on and off by a changeover means to make a selection between activated state and deactivated state, two or more pairs of analog switches required in conventional signal processors are unnecessary. Since the changeover means for turning on and off the power source can be constituted by a single MOSFET device, a signal processor of a simple structure is realized.

Further, since the buffers are deactivated, the signal processor is not affected by the output offset characteristic, so that the causes of flickers can be prevented. Since an operation such that a plurality of switches are turned on and off is not performed, the timing of the on/off control hardly deviates, so that the causes of video noises can also be prevented.

Obviously, many modifications and variations of the present invention are possible in light of the above teachings. It is therefore to be understood that within the scope of the appended claims, the invention may be practiced other than as specifically described.

What is claimed is:

1. A signal processor comprising:

a first input terminal supplied with a first signal;

a second input terminal supplied with a second signal;

first and second input buffers connected to the first and second input terminals, respectively;

a first capacitor connected to an output side of the first input buffer and to a reference potential point for holding the first signal;

a second capacitor connected to an output side of the second input buffer and to the reference potential point for holding the second signal;

a first output buffer connected to the first capacitor;

a second output buffer connected to the second capacitor;

an output terminal supplied with outputs of the first and second output buffers;

a power source for activating the first and second input buffers and the first and second output buffers; and switch means which alternately repeats a first period during which the first input buffer and the second output buffer are connected to the power source and a second period during which the second input buffer and the first output buffer are connected to the power source.

2. A signal processor according to claim 1, wherein said first and second input buffers, said first and second output buffers and said switch means are each constituted by a metal oxide semiconductor transistor.

3. A signal processor according to claim 1, wherein said first and second signals are video signals, and wherein said output terminal is connected to a video display device.

4. A signal processor according to claim 3, wherein changeover of said switch means is controlled by a pulse for each pixel of the display device.

5. A signal processor according to claim 3, wherein said video display device is a liquid crystal display device.

6. A signal processor according to claim 1, wherein the buffers are composed of a first transistor circuit, and wherein the switch means is composed of a second transistor circuit and includes a plurality of transistors, each of the plurality of transistors receiving at its gate electrode a switching pulse, being connected at its second electrode to the first transistor circuit, and being connected at its third electrode to the power source.

7. A signal processor comprising:

a first input terminal supplied with a first video signal of a first field;

a second input terminal supplied with a second video signal of a second field;

first and second input buffers connected to the first and second input terminals, respectively;

a first capacitor connected to an output side of the first input buffer and to a reference potential point for holding the first signal;

a second capacitor connected to an output side of the second input buffer and to the reference potential point for holding the second signal;

a first output buffer connected to the first capacitor;

a second output buffer connected to the second capacitor;

an output terminal supplied with outputs of the first and second output buffers and supplying the outputs to a liquid crystal display device of a non-interlace type;

a power source for activating the first and second input buffers and the first and second output buffers; and switch means for alternately connecting 1) the first input buffer and the second output buffer to the power source during a first period and 2) the second input buffer and the first output buffer to the power source during a second period, wherein changeover of said switch means is controlled by a pulse for each pixel of the display device.

* * * * *